US005803149A

United States Patent [19]

Halley et al.

[11] Patent Number: 5,803,149

[45] Date of Patent: Sep. 8, 1998

[54] JACK SHAFT GARAGE DOOR OPERATOR

[75] Inventors: Ronald W. Halley, Des Plaines; Bradford Farris, Chicago, both of Ill.; Colin B. Willmott, Landsweiler, Germany

[73] Assignee: The Chamberlain Group, Inc., Elmhurst, Ill.

[21] Appl. No.: 864,559

[22] Filed: May 28, 1997

Related U.S. Application Data

[63] Continuation of Ser. No. 457,520, Jun. 1, 1995, abandoned.

[51] Int. Cl.[6] ..... E05D 15/06

[52] U.S. Cl. ..... 160/201; 49/199

[58] Field of Search ..... 49/199, 200; 160/188, 160/189, 190, 192, 201, 209

[56] References Cited

U.S. PATENT DOCUMENTS

| | | | |
|---|---|---|---|
| 1,465,695 | 8/1923 | Stewart | 49/200 |
| 2,096,251 | 10/1937 | Knight et al. | 49/139 |
| 3,147,001 | 9/1964 | Purdy | 49/139 |
| 3,311,159 | 3/1967 | Stansberry | 160/189 |
| 3,412,780 | 11/1968 | Moler | 160/191 |
| 4,085,629 | 4/1978 | Fogarollo | 49/139 |
| 4,241,540 | 12/1980 | Depperman | 49/199 |
| 4,274,227 | 6/1981 | Toenjes | 49/199 |
| 4,460,030 | 7/1984 | Tsunemura et al. | 160/35 |
| 4,472,910 | 9/1984 | Iha | 49/139 |
| 4,538,661 | 9/1985 | Henry et al. | 160/35 |
| 4,597,428 | 7/1986 | Iha | 160/188 |
| 4,653,565 | 3/1987 | Iha et al. | 160/193 |
| 5,056,847 | 10/1991 | Stillwell et al. | 296/50 |

FOREIGN PATENT DOCUMENTS

| | | |
|---|---|---|
| 2317458 A | 6/1976 | France . |
| 1527046 | 10/1978 | United Kingdom . |

OTHER PUBLICATIONS

"SpecData", from Door Oper. & Remote Controls Mfs. Assn. & Nat'l Assn. of Garage Door Mfs., Nov. 1983 (supersedes Feb. 1977).

"Architectural Specifications", manufactured by Link Controls, 2111 Lakeland Avenue, Ronkonoma, NY 11779.

"Instructions for Installation of 139.53709 Quick Turn Brackets," Document No. 114A798, published by the Chamberlain Group, Inc. more than one year before Jun. 1, 1995.

"ATL Rolls Out the Best Warranty in the Industry," Arrow Tru–Line, Inc., published more than one year before Jun. 1, 1995.

"Posi–Tension Drums . . . One of the Many Reasons Why You Should Be Getting 'The Original' . . . 'Overhead Door'", published more than one year before Jun. 1, 1995.

Garage Door Opener Owner's Manual, Series 651–2MM–1/2HP, Series 601MM–1/2HP, Series 151MM–1/4HP, The Chamberlain Group, Inc., published 1993.

Lift Master Model MJ Series 1000 Commercial Operator Medium Duty Jack Shaft Operator, published by The Chamberlain Group, Inc. more than one year before Jun. 1, 1995.

Model GJ Series 3000 Commercial Operator Gear Head Jack Shaft Operator, published by The Chamberlain Group, Inc. more than one year before Jun. 1, 1995.

*Primary Examiner*—Daniel P. Stodola
*Assistant Examiner*—Curtis Cohen
*Attorney, Agent, or Firm*—Fitch, Even, Tabin & Flannery

[57] ABSTRACT

A jack shaft garage door operator is used for positively opening and closing a garage door and includes a jack shaft garage door operator drive having an electric motor. The electric motor is connected to a jack shaft garage door operator transmission. The transmission includes an opening flexible link storage unit or cable drum having an opening flexible link cable drive wrapped around it. Also connected to the jack shaft is a second cable drum having a closing flexible link or closing cable wound in the opposite direction from the opening cable. A compressional force transmitting member comprising a quick-turn bracket couples the closing cable to the garage door and is itself connected to an upper portion of the garage door to transmit a positive closing force to the garage door throughout its entire travel as the closing cable is drawn in and the opening cable is payed out under the operation of the electric motor.

10 Claims, 5 Drawing Sheets

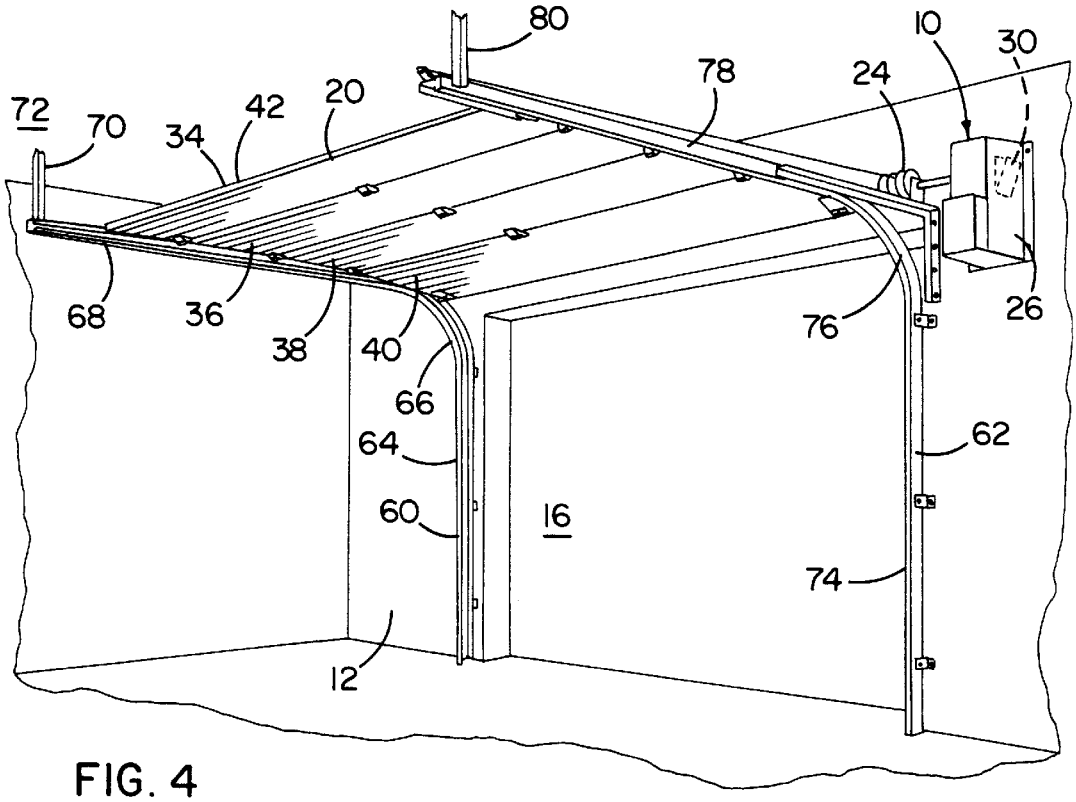
FIG. 4
FIG. 5
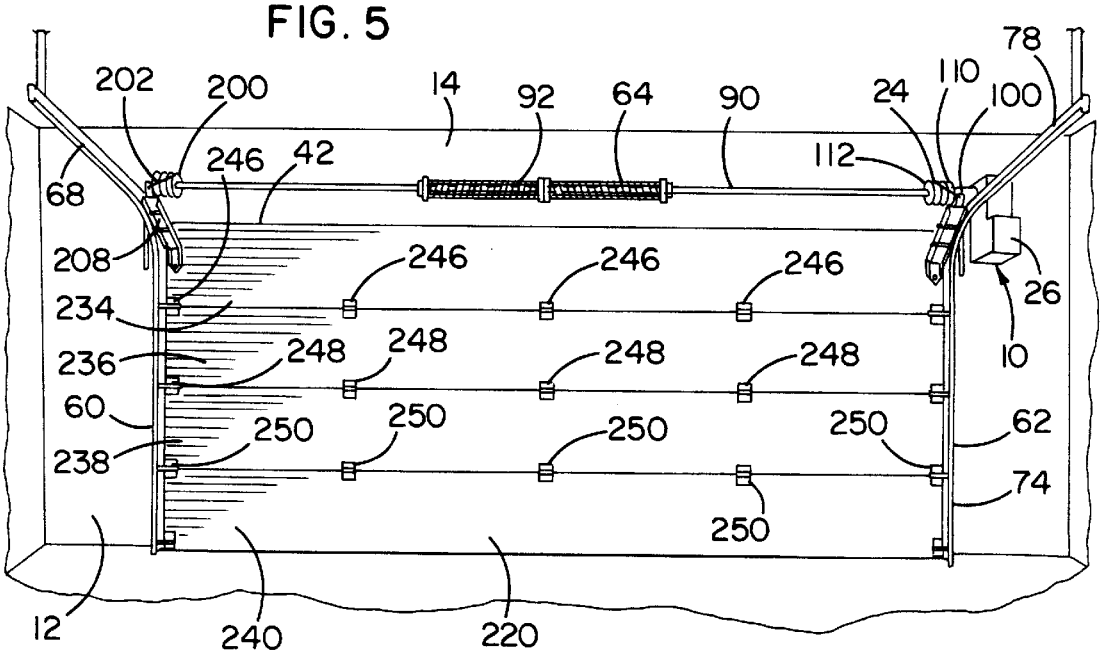

JACK SHAFT GARAGE DOOR OPERATOR

This application is a continuation of application Ser. No. 08/457,520 filed Jun. 1, 1995, now abandoned.

BACKGROUND OF THE INVENTION

The invention relates to a garage door operator. In particular it relates to a jack shaft garage door operator having a compact and modular jack shaft drive and associated jack shaft power transmission for positively opening and closing a garage door.

Conventional garage door operators of the T-rail or screw drive type are adequate for use in roomy garages which allow hanger brackets to be connected from the ceiling down to the region of the T-rail and/or screw drive. However, a number of garages, such as older garages in the Eastern portion of the United States, often have relatively low ceilings. A T-rail or screw drive could not be used because it would be mounted below the upper edge of the garage door and block the door opening.

Jack shaft garage door operators have often been used in garages having low ceilings which cannot accommodate T-rail or screw drive type garage door operators. A jack shaft operator typically has a housing having a control unit and an electric motor inside. The motor is drivingly connected to a jack shaft which is positioned parallel with an upper edge of the door and rotatably mounted above the garage door frame. A torsion spring is wound around the jack shaft to provide a restoring force to it. A cable drum attached to the jack shaft is rotatably driven by it and has a pull-up cable wound thereabout and extending from it to the garage door. The pull-up cable usually connects near a bottom edge of the garage door so that when the cable drum is rotated by the motor, the pull-up cable is taken up on the cable drum lifting the garage door. The door is closed by the combination of the restoring force of the torsion spring releasing the pull-up cable and the portion of the weight of the door which is unsupported by the rails or other structure carrying the door.

It may be appreciated that when a multi-panel hinged door is in its uppermost position almost its entire weight is being carried on the rail system with the exception of a portion of the weight of the bottommost panel. The force due to the weight tending to close the door is relatively low. The force due to the torsion spring cannot be overly large or the electric motor would not have sufficient torque to raise the door fully. Thus when the door is to be closed, the motor is operated in the reverse direction, unwinding the cable from the cable drum and allowing both the restoring torque of the spring, as well as the unsupported weight of the door be reversed to move the door toward the closed position. Of course, it may be appreciated that as the spring is unwound as the door is closing, the restoring force of the spring decreases while the unsupported weight of the door increases.

When the garage door is near the bottom of its travel, for instance about 3.81 centimeters (1.5 inches) off the floor, there is very little difference between the force on the door at that point and the force on the door as it adjoins the floor at the end of its travel. This presents a problem because United States safety certification requirements mandate that the door, on encountering a 3.81 centimeters (1.5 inches) obstruction at the bottom of its travel. Most garage door operators use a force sensing apparatus that detects an increase in the force applied by the garage door operator when the door contacts the barrier.

In the case of jack shaft units, however, no increase in force may be detected because the door is simply being allowed to be lowered to that point and the motor would tend to continue to reel out cable, causing the cable possibly even to come off the cable drum. This would result in a repair which the homeowner would likely not be able to carry out due to the force required to handle the torsion spring.

In order to solve this problem, in the past a number of modified jack shaft units have been developed incorporating pairs of cables, one causing the door to be positively lowered and one causing the door to be positively raised. This solves a number of problems which such jack shaft units as preventing the door from binding in the up position and providing sufficient force to start the door rolling toward the closed position.

U.S. Pat. No. 4,460,030 to Tsunemura et al. discloses a sectional and collapsible overhead garage door 10 having a plurality of hinged panels 11 through 20. An electric motor 71, operating in response to a control 91, supplies torque to a drive shaft 57 positioned above the door. On each side of the door 10 are respective pull-up reels 58 and 62 having pull-up cables attached thereto and pull-down reels 59 and 61 having pull-down cables threaded through idlers such as idler 68. The pull-up and pull-down reels are driven by the drive shaft to cause the pull-up and pull-down cables to open and close the garage door.

U.S. Pat. No. 4,472,910 to Iha discloses a garage door operator having a motor 31 coupled to a drive shaft 26. A pair of pull-up reels 41 and 42 are mounted on the drive shaft at opposite edges of a garage door 10 and respectively carry cables 43 and 46. The cables are connected to a lower panel 14 of the garage door 10 at points 44 and 47 via suitable clamps. A pull-down reel 54 is coupled to the shaft 26 to be driven thereby and carries a cable 56 which passes through a pulley 57 mounted at the bottom edge of the door 10 by a bracket 58. When the door 10 is in the down position and the motor 31 is energized, the shaft 26 rotates the pull-up reels 41 and 42 causing the cables 43 and 46 to raise the door 10. The shaft 26 is driven in the opposite direction to close the garage door by causing the pull-down cable 56 to be wound about the pull-down reel 54 as cables 43 and 46 are paid out by the pull-up reels 41 and 42.

U.S. Pat. No. 4,538,661 to Henry et al. discloses a garage door operator having a jack shaft type unit. A pair of cables extends near the door on each edge thereof. The cables open and close the door positively. Counterbalance springs 127 are attached between respective door brackets and pulleys.

The three aforementioned prior art systems, however, suffer from the problem that the relatively long cable travel through the pulley biased by a long spring results in a structure that often lacks sufficient force to cause the garage door to travel uniformly and close uniformly. The movable idler biased by the floor-mounted spring is relatively time-consuming and expensive to install as it requires the attachment of equipment not only immediately above the garage door, where it may be easily mounted, but also attached below the garage door which may necessitate sinking mounts into holes drilled into concrete. The concrete work is labor-intensive and would add considerably to the cost of installing the garage door operator.

In addition, by using further moving elements, such as idler pulley positioned near the floor there is an additional chance that extraneous materials may be caught in the idler pulleys or persons may be injured when coming in contact with the pulleys as the door is being opened or closed.

SUMMARY OF THE INVENTION

A jack shaft garage door operator is disclosed herein. The garage door operator includes a compact and modular jack shaft garage door operator drive comprising an electric motor and speed reducing transmission. The motor and speed reducing transmission are mounted within a housing and provide low speed, high torque rotary drive motion at a power take-off shaft. The jack shaft garage door operator also includes a transmission which is connected to the power take-off shaft to raise and lower a garage door. More specifically, the jack shaft garage door operator is mounted inside a parking structure or garage on a wall thereof immediately above the door opening and slightly offset near an edge thereof. The jack shaft drive unit is drivingly connected to the transmission. The transmission, in turn, is connected to a jack shaft which comprises a portion of the garage door structure and has a torque providing helical spring wound thereabout for providing a restoring torque to the jack shaft. A pair of flexible link storage units, more specifically an opening flexible link storage unit, comprising an opening cable drum, and a closing flexible link storage unit, comprising a closing cable drum, are mounted on the jack shaft to be turned therewith by the electric motor. An opening flexible link, comprising a flexible steel cable, is wound about the opening cable drum and extends downwardly along the door and is connected to the door by a connector near the bottom edge thereof. A closing flexible link, comprising a closing steel cable, is wound about the closing drum and is connected through a spring to a compressional force transmitting member or arm which consists of a base plate connected to an upper portion of the garage door and a pivoting arm section pivotally mounted upon the base plate.

The jack shaft garage door operator occupies very little space because it is mounted on the wall of the garage immediately above the garage door. It does not require a long perpendicularly extending member of the type used in a T-rail garage door operator or a screw drive garage door operator. In one environment the jack shaft operator can include closing cables and opening cables connected along opposite edges of a large door to provide balanced closing and opening force thereto to prevent the door from jamming, particularly in the up position due to uneven roads which may torque the door with respect to the rails on which the door rollers ride.

In addition, the present invention overcomes some of the other problems with the prior art in that the transmission for the garage door operator does not entail any connections to other portions of the garage structure other than through the cable drums to the jack shaft drive. There is no connection needed to the garage floor, nor to other fixtures near the garage floor, in order to provide closing force to the garage door.

In addition, the closing force is provided in such a way that by extending through the compression force transmitting member, it may be applied to the upper portion of the garage door and positively close the door by supplying a positive closing force thereto throughout its entire travel. Thus, if the door encounters an obstacle in the bottom 3.81 centimeters (1.5inches) of its travel, the closing force would be sensed by the jack shaft unit as the closing force may be sensed by conventional T-rail units and cause the garage door operator immediately to reverse and to raise.

It is a principal aspect of the present invention to provide a jack shaft garage door operator having a drive unit and transmission which are compact and provides positive opening and closing force to a garage door.

It is another aspect of the present invention to provide a garage door operator drive unit and garage door operator transmission which need only be mounted to the garage door without requiring mounting to the floor of the garage for the drive structure.

It is still another aspect of the present invention to provide a jack shaft garage door operator drive unit and a jack shaft garage door operator transmission which provide closing force to the garage door throughout the entire length of the garage door travel.

Other aspects of the present invention will become apparent to one of ordinary skill in the art upon review of the specification and claims in light of the accompanying drawings.

BRIEF DESCRIPTION OF THE DRAWINGS

FIG. 4 is a perspective view of the garage door and garage door operator shown in FIGS. 2 and 3 with the door positioned in the fully open position;

FIG. 5 is a perspective view of a two-car garage showing details of the garage door and having a garage door operator having cables on each side of the garage door;

DETAILED DESCRIPTION OF THE PREFERRED EMBODIMENTS

Figure 1:
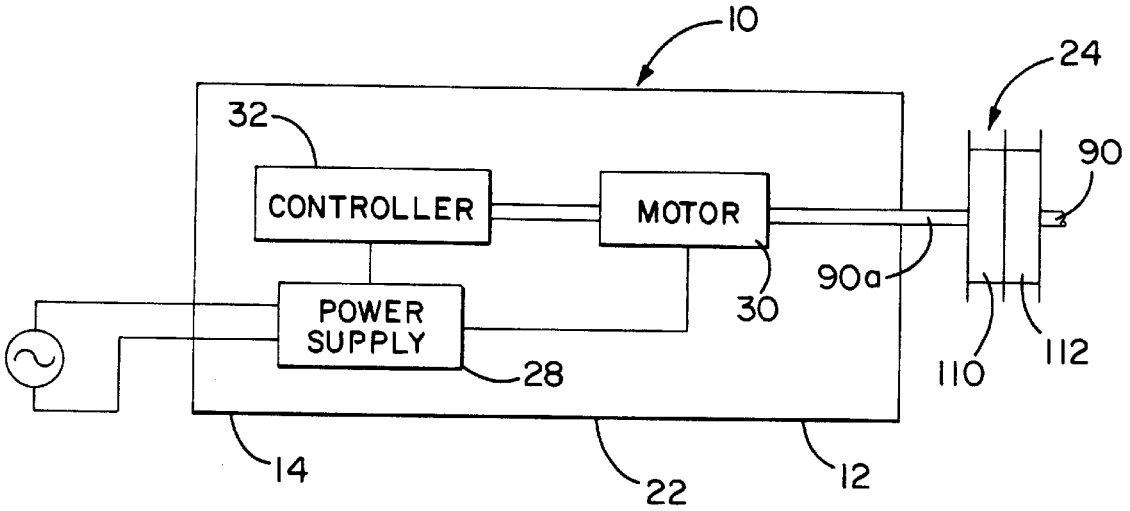
FIG. 1 is a block diagram showing a jack shaft garage door operator embodying the present invention.
Figure 7:
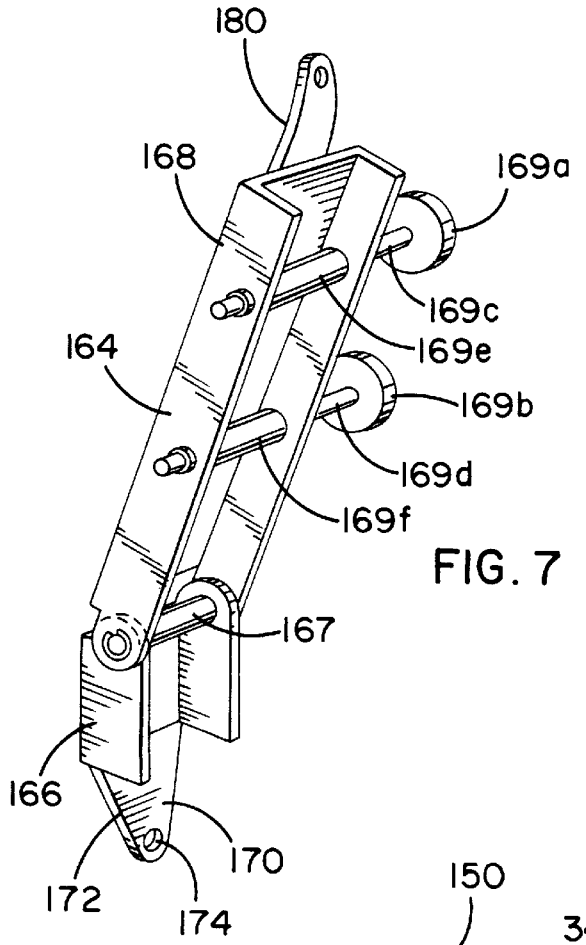
FIG. 7 is an isometric view of a force-supplying closure arm to be connected via a spring to a closure cable and to be connected to the garage door.

Referring now to the drawings, and especially to FIG. 1, a jack shaft garage door operator embodying the present invention is generally shown therein and identified by numeral 10. The jack shaft garage door operator 10 is mounted inside a parking structure or garage 12 on a wall 14 thereof immediately above a vehicle or garage door opening 16 which may be selectively closed by a multiple panel garage door 20. The jack shaft garage door operator 10 includes a drive unit 22, specifically a jack shaft drive unit, having a garage door operator transmission 24 connected to it to be driven thereby. The drive unit 22 includes a housing 26 having means for receiving electric power 28 positioned therein. An electric motor 30 is connected to the power receiving means 28 to be energized thereby when a controller 32, also energized by the power receiving means 28, enables the electric motor 30 to turn in order to open or close the garage door 20.

The multiple panel garage door 20 includes a plurality of rectangular door panels, respectively numbered 34, 36, 38 and 40. The door panel 34 has an upper door edge 42. The door panel 40 has a lower door edge 44. The door panels 34 and 36 are connected by a plurality of hinges 46. Panels 36 and 38 are connected by a plurality of hinges 48. Panels 38 and 40 are connected by a plurality of hinges 50. The outer hinges 46, 48 and 50 have rollers connected thereto to movably support the garage door 20 upon curved guide rails. The hinges allow the door panels to articulate with respect to one another so that they can negotiate curved guide rails or tracks. The rollers associated with the hinges 46, 48 and 50 of the garage door 20 engage and ride in a pair of L-shaped tracks 60 and 62. The L-shaped track 60 has a vertical straight section 64, a curved section 66 and a substantially horizontal straight section 68 suspended by a hanger 70 from a ceiling 72 of the garage. The L-shaped track 62 likewise has a vertical straight section 74, a curved section 76 and a substantially horizontal straight section 78 which is suspended by a hanger 80 from the garage ceiling 72. The garage door 20 is also supported in part by a rotatable jack shaft 90 extending across the wall 14 above the upper edge 42 of the garage door 20. A helical torsion spring 92 applies torsion to the jack shaft 90 to support the garage door 20.

Figure 6:
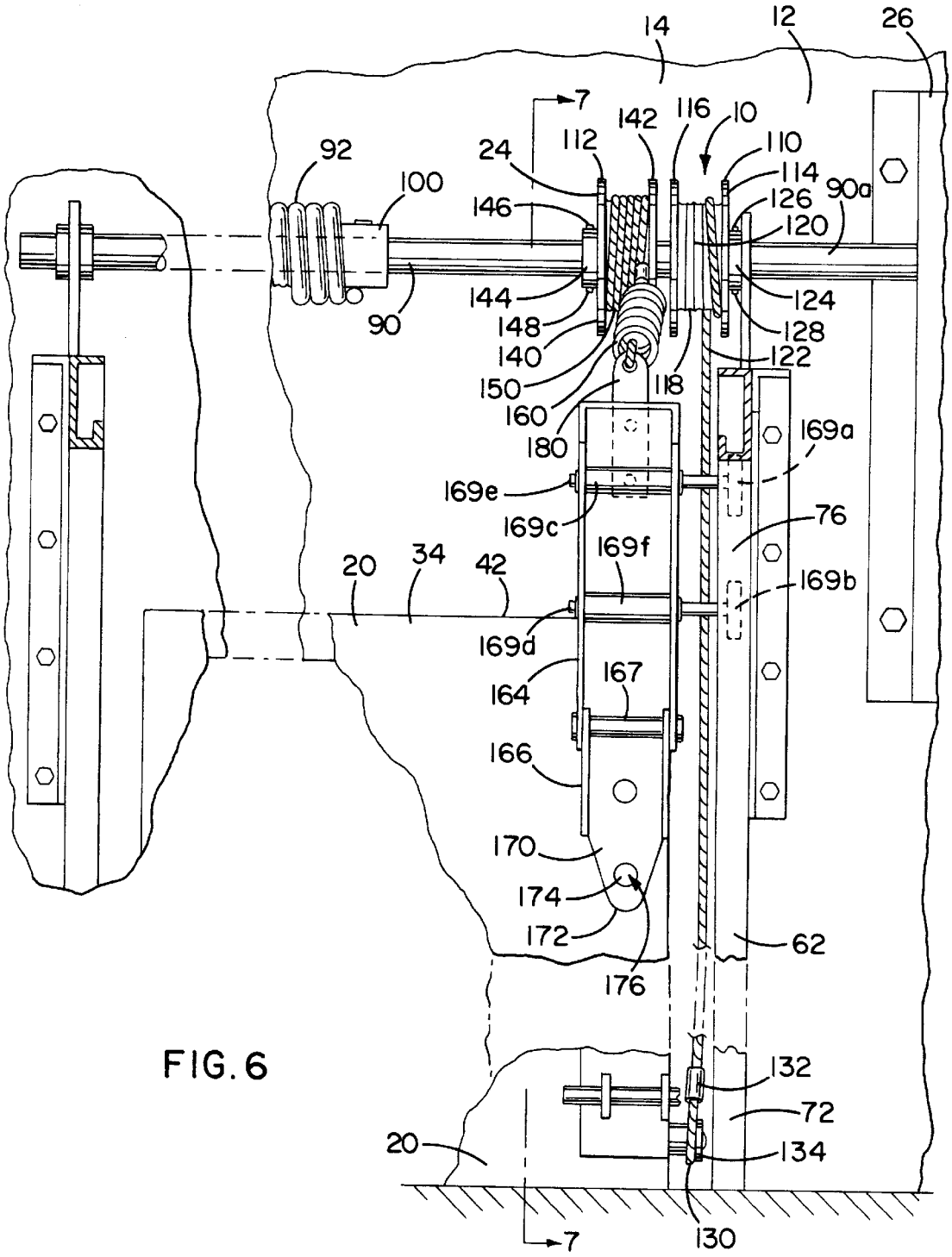
FIG. 6 is an elevational view having portions broken away showing details of a portion of the compact and modular jack shaft garage door operator.

The jack shaft 90 comprises a portion of the garage door operator transmission 24 and is connected to be driven by a power take-off shaft 90*a* coupled to the electric motor 30 via an internal gear reducer. As shown in FIG. 6, the torsion spring 92 terminates at one end in a collar 100 which is secured to the jack shaft 90. A pull-up cable drum or opening flexible link storage unit 110 and a pull-down cable drum or closing flexible link storage unit 112 are connected to the jack shaft 90. The pull-up cable drum 110 includes a pair of disk-like sides 114 and 116 having a center portion 118 with a plurality of indentations 120 formed therein to receive a steel pull-up cable or opening flexible link 122 to be wound thereon. The pull-up drum 110 is secured via a collar 124 and locking screws 126 and 128 to the jack shaft 90. The pull-up cable 122 forms a loop end 130 which is secured by a collar 132. A stud 134 extends from the bottom portion of the door 20 near the bottom edge and is engaged by the pull-up cable 122 to be drawn up thereby. Thus, when the cable drum 110 is rotated by the jack shaft 90 to wind cable onto the drum 110, the right side of the door 220 is pulled up.

In order to pull the door 20 down, the pull-down cable drum 112 is provided having a pair of circular disks 140 and 142 with a center section positioned therebetween. The pull-down cable drum 112 is substantially identical to the pull-up cable drum 110. A collar 144, having a pair of set screw holders 146 and 148, irrotationally secures the cable drum 112 to the jack shaft 90. A steel pull-down cable or closing flexible link 150 is wound about the pull-down cable drum 112.

Figure 10:
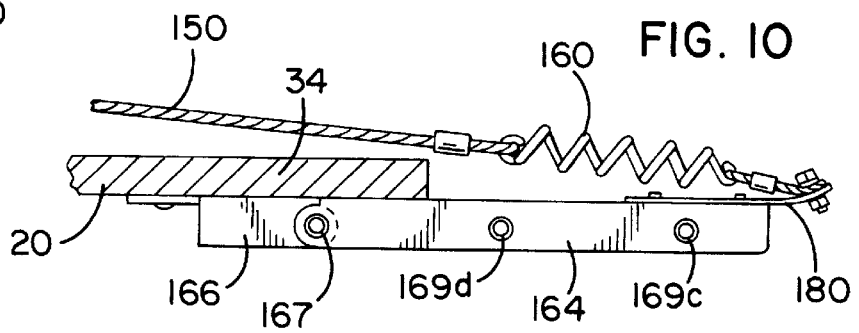
FIG. 10 is an isometric view of a portion of the closure arm as oriented when the garage door is in the opened position to show details of the closure arm.
Figure 2:
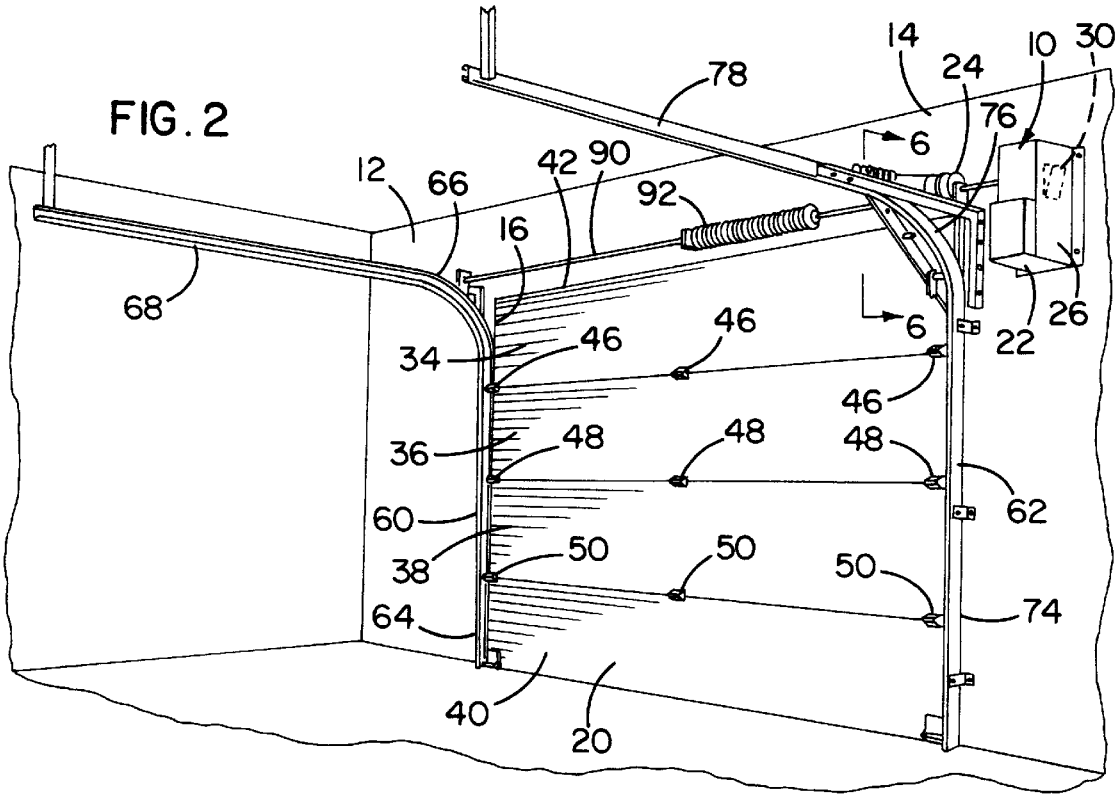
FIG. 2 is a perspective of view of a garage having a garage door with the door in the closed positioned and being drivable by the jack shaft garage door operator embodying the present invention.
Figure 3:
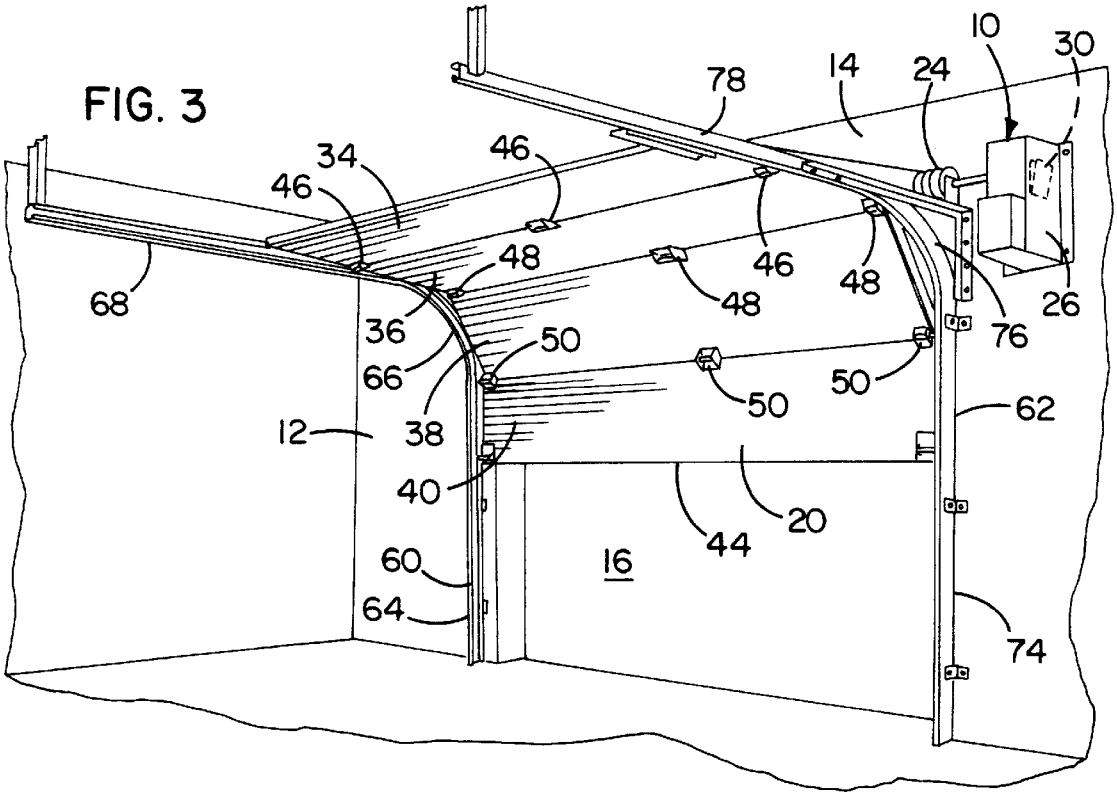
FIG. 3 is a perspective view, taken from the same position as FIG. 2, but showing the garage door partially open.
Figure 8:
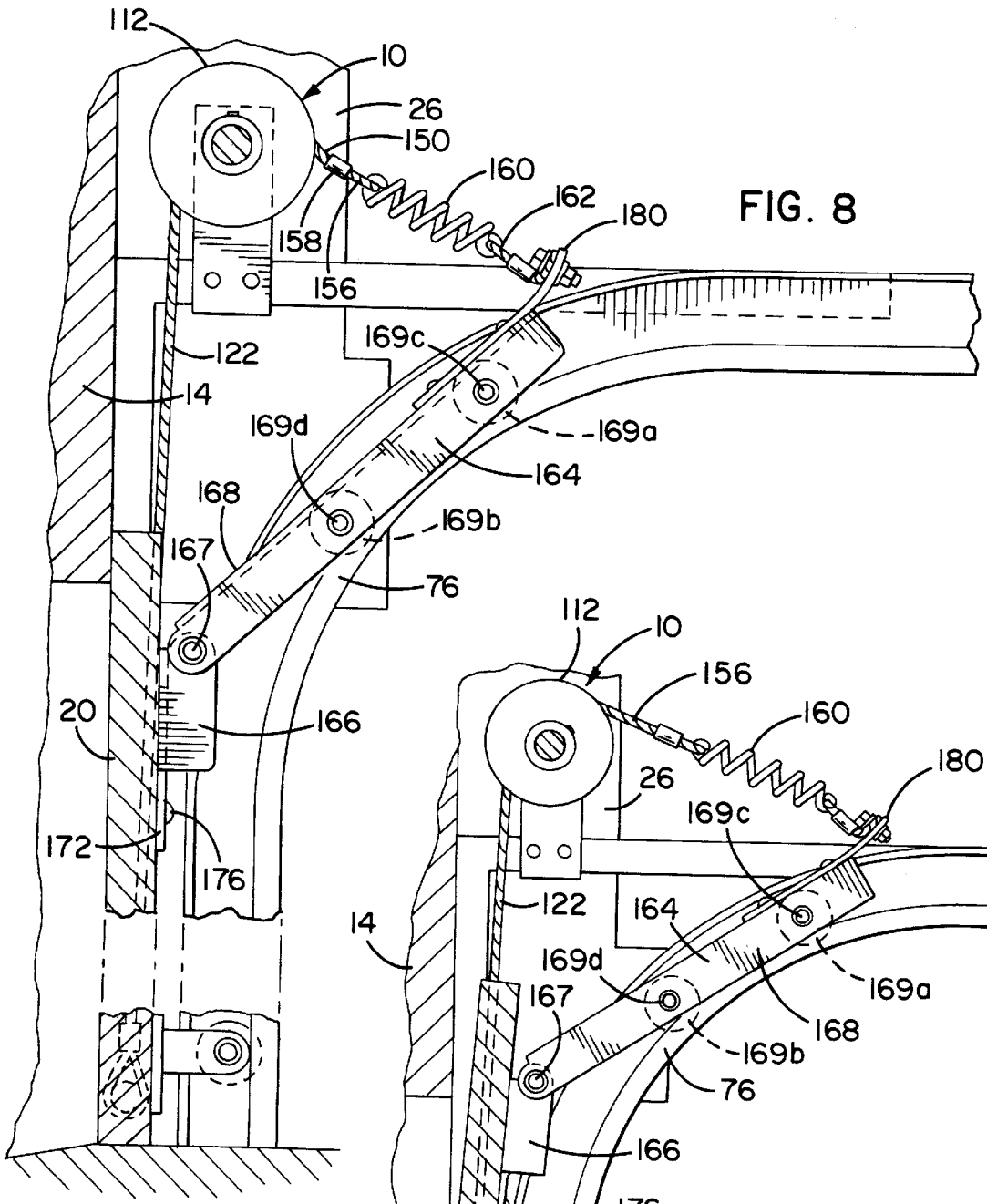
FIG. 8 is a view, partially in section, of the detail of the force-supplying closure arm and the garage door to which it is attached when the door is in a closed position.
Figure 9:
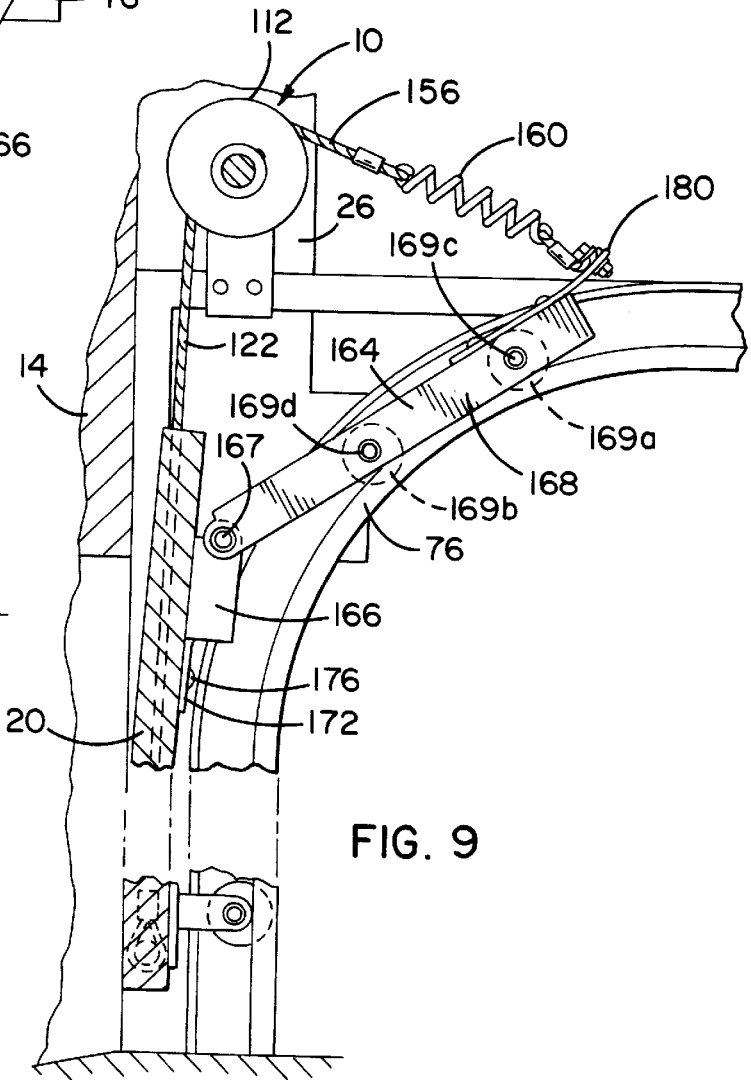
FIG. 9 is a similar sectional view showing the door as it is beginning to open.

The cable 150 terminates in a cable loop 156 having a collar 158 thereon and is connected to a helically coiled tension spring 160 connected by a short length of cable 162 to a compressional force transmitting member or arm 164 which is comprised of a quick-turn bracket of the type available from Arrow Tru-Line, Inc., Route 66, Archbold, Ohio, and which has previously been used by the assignee in combination with T-rail type garage door operators to allow the trolley to easily move the door panels around the curved portion of the guide rail. The quick-turn bracket, however, in that application does not have either an opening or closing force applied to it. It is only connected to the top door panel and rolls in the track to rotatably bias the upper panel as the door opens and closes. The compressional force transmitting arm 164 includes a door mount section 166 having a pivot pin 167 mounted thereto and the pivot pin 167 having pivotally connected thereto a rotatable arm 168. A pair of rollers 169*a* and 169*b* engage the L-shaped track 62 and are respectively mounted on a pair of roller pins 169*c* and 169*d*. The roller pins 169*c* and 169*d* are respectively rotatably supported by a pair of sleeves 169*e* and 169*f*. The door mount section 166 includes a base plate 170 having a tapered threaded fastener receiving tongue 172 extending therefrom. An aperture 174 is formed therein to receive a threaded fastener 176. When the door 20 is in its uppermost position. As is best shown in FIG. 4, the electric motor 30 can rotate the cable drum 112 causing the cable 150 to be reeled thereon which increases the tension on the spring 160, pulling the end bracket 180 into compression, thereby placing a compressional force on the arm 164, which is transmitted through the mount 166 to the garage door 20. The relative positions when the garage door 20 is completely open are best shown in FIG. 10. As the garage door 20 is pulled toward its closed position, for instance, when the garage door 20 is approximately 3.81 centimeters (1.5 inches) off the ground, the relative position is best seen in FIG. 9 and it may be appreciated that positive force is continued to be provided to the top of the garage door 20 not only allowing for a quick turn of the upper panel of the garage door 20 around the track portion 76 while closure force is supplied by the cable 150, but causing the garage door 20 to be fully closed as well. The closed position of the garage door 20 is shown in FIG. 8 where continuing tension by the cable 150 on the spring 160 holds the garage door 20 closed. Thus, the pull-down cable, in combination with the arm 164, allows the garage door 20 to be drawn closed and held closed in a locked position.

The rollers of the quick-turn arm are carried entrapped by the tracks 60 and 62. The quick-turn arm, however, among other things, minimizes the variation in the angle of the pull-down cable with respect to the horizontal sections of the tracks. It maintains the angle substantially in parallel with the tracks so that all of the tensional force is being supplied with the door and there is no significant transverse component tending to jam the door panel in the tracks. The quick-turn arm also, by providing an extension, prevents the pull-down cable from getting slack which might result in the cable being tangled or coming off the drum. Furthermore, the quick-turn arm helps the top panel to be carried around the curve quickly and easily without jamming and helps to clear the high points in the travel where the edge of the door would normally travel above the track as the top panel is pivoting to provide for full closure of the door. The pull-down cable, it may be appreciated, also provides locking for the door as when the jack shaft 90 is held irrotational by the motor being stopped. The door may not be opened because it places the pull-down cable in tension.

In the event that a wide garage door, for instance a two-car garage door 220 of the type shown in FIG. 5, is to be used, a pull-up cable reel 200 and a pull-down cable reel 202 are positioned at the far end of the jack shaft 90 opposite cable reels 110 and 112. The first torsion spring 92 and a second torsion spring 92*a* bias the door 220 upwardly to counter balance a portion of the otherwise unsupported weight of the door 220. The garage door 220 includes multiple hinged panels 234, 236, 238 and 240 that are pivotable with respect to one another. The hinged panels 234 and 236 are connected by a plurality of hinges 246. The hinged panels 236 and 238 are connected by a plurality of hinges 248. The hinged panels are connected by a plurality of hinges 250. In addition, a second compressional force receiving device 208 identical to the compression force receiving device 164 is attached to the door 220 at the upper left hand corner thereof, and thereby provides uniform closing force on both sides of the door 220. The pull-up cable extends all the way down the door to the bottom thereof and provides uniform opening force thereto.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A jack shaft garage door operator transmission for use with a jack shaft garage door operator drive from which it is driven and for mounting on a wall above and near a garage door opening of a parking structure to open and close a multi-panel garage door comprising:

a track mounted near the garage door opening for carrying the multi-panel garage door, the track having a horizontal section and a vertical section coupled by a curved section having a curved outer boundary on a radius of curvature of the curved section;

an opening flexible link for connection to the multi-panel garage door for supplying a tensional force for opening the multi-panel garage door;

an opening flexible link storage unit connectable to a jack shaft drive to be driven thereby and connectable to the opening flexible link for reeling in the opening flexible link for storage as the multi-panel garage door is drawn open by it and for paying out the opening flexible link as the multi-panel garage door is being closed;

a closing flexible link for connection to the multi-panel garage door for supplying a tensional force at least a portion of which is applied as a closed force for closing the multi-panel garage door;

a closing flexible link storage unit connectable to the jack shaft drive unit to be driven thereby and connected to the closing flexible link for reeling in the closing flexible link for storage as the garage door is being closed by it and for paying out the closing flexible link as the multi-panel garage door is being opened by the opening flexible link;

a compressional force transmitting member comprising a door mounting bracket for attachment to the multi-panel garage door and a pivot arm pivotally attached to the door mounting bracket, the pivot arm adapted to be rollably mounted for travel along the track; and means for providing a resilient closing force between an end of the closing flexible link and the compressional force transmitting member, the resilient closing force means is mounted outside the outer boundary and outside the radius of curvature of the track, the compressional force transmitting member coupled to the closing flexible link and adapted for connection to an upper portion of the multi-panel garage door to transfer a uniform positive closing force to the multi-panel garage door irrespective of the position of the multi-panel garage door, the compressional force transmitting member and the resilient closing force means preventing slack in the closing flexible link during the movement of the multi-panel garage door around the curved section of the track.

2. A jack shaft garage door operator transmission for use with a jack shaft garage door operator drive from which it is driven and for mounting near a garage door opening of a parking structure to open and close the garage door according to claim 1, wherein said opening flexible link storage unit comprises a drum for mounting upon a jack shaft driven by the jack shaft drive.

3. A jack shaft garage door operator transmission for use with a jack shaft garage door operator drive from which it is driven and for mounting near a garage door opening of a parking structure to open and close the garage door according to claim 1, wherein said opening flexible link comprises a cable.

4. A jack shaft garage door operator transmission for use with a jack shaft garage door operator drive from which it is driven and for mounting near a garage door opening of a parking structure to open and close the garage door according to claim 1, wherein the resilient closing force means comprises a spring mounted to the pivot arm.

5. A jack shaft garage door operator transmission for use with a jack shaft garage door operator drive from which it is driven and for mounting near a garage door opening of a parking structure to open and close the garage door as recited in claims 1 or 4, wherein the pivot arm includes at least two pairs of rollers adapted to be mounted on the track.

6. A jack shaft garage door operator for mounting in proximity with a garage door opening of a parking structure and for opening and closing a multi-panel garage door, comprising:

a track mounted near the garage door opening for carrying the multi-panel garage door, the track having a horizontal section and a vertical section coupled by a curved section having a curved outer boundary on a radius of curvature of the curved section:

a jack shaft garage door operator drive adapted for mounting on a wall;

an opening flexible link drive for coupling to the multi-panel garage door for supplying a tensional force for opening the multi-panel garage door;

an opening flexible link storage unit connected to the jack shaft garage door operator drive to be driven thereby and connected to the opening flexible link for reeling in the opening flexible link for storage as the multi-panel garage door is drawn open by it and for paying out the opening flexible link as the multi-panel garage door is being closed;

a closing flexible link for coupling to the multi-panel garage door for supplying a tensional force at least a portion of which is applied as a closing force for closing the multi-panel garage door;

a closing flexible link storage unit connected to the jack shaft garage door operator drive to be driven thereby and connected to the closing flexible link for reeling in the closing flexible link for storage as the multi-panel garage door is being closed by it and for paying out the closing flexible link as the multi-panel garage door is being opened by the opening flexible link;

a compressional force transmitting member comprising a door mounting bracket for attachment to the multi-panel garage door and a pivot arm pivotally attached to the door mounting bracket, the pivot arm adapted to be rollably mounted for travel along the track; and means for providing a resilient closing force between an end of the closing flexible link and the compressional force transmitting member, the resilient closing force means is mounted outside the outer boundary and outside the radius of curvature of the track, the compressional force transmitting member for coupling the closing flexible link to the multi-panel garage door and adapted for connection to an upper portion of the multi-panel garage door to provide a uniform positive closing force to the multi-panel garage door irrespective of its position, the compressional force transmitting member and the resilient closing force means preventing slack in the closing flexible link during the movement of the multi-panel garage door around the curved section of the track.

7. A jack shaft garage door operator for mounting in proximity with a garage door opening of a parking structure and for opening and closing a garage door according to claim 6, wherein said opening flexible link storage unit comprises a drum for mounting upon a jack shaft driven by the garage door operator drive.

8. A jack shaft garage door operator for mounting in proximity with a garage door opening of a parking structure and for opening and closing a garage door according to claim 6, wherein said opening flexible link comprises a cable.

9. A jack shaft garage door operator for mounting in proximity with a garage door opening of a parking structure and for opening and closing a garage door according to claim 6, wherein the resilient closing force means comprises a spring mounted to the pivot arm.

10. A jack shaft garage door operator for mounting in proximity with a garage door opening of a parking structure and for opening and closing a garage door as recited in claims 6 or 9, wherein the pivot arm includes at least two pairs of rollers adapted to be mounted on the track.

* * * * *